United States Patent [19]

Yamazoe et al.

[11] 4,378,766

[45] Apr. 5, 1983

[54] CLOSED LOOP IDLE ENGINE SPEED CONTROL WITH A VALVE OPERATING RELATIVE TO NEUTRAL POSITION

[75] Inventors: Hisamitsu Yamazoe, Kariya; Ichita Sogabe, Gifu; Kazuyoshi Tamaki, Nagoya; Matsuju Yoshida, Bisai, all of Japan

[73] Assignee: Nippondenso Co., Ltd., Kariya, Japan

[21] Appl. No.: 236,627

[22] Filed: Feb. 20, 1981

[30] Foreign Application Priority Data

Feb. 22, 1980 [JP] Japan ..... 55-21765

[51] Int. Cl.[3] ..... F02M 51/06; F02D 11/10; F02D 1/04; B05B 1/30

[52] U.S. Cl. ..... 123/339; 123/340; 123/585; 251/137; 251/129

[58] Field of Search ..... 123/339, 340, 585; 251/137, 129

[56] References Cited

U.S. PATENT DOCUMENTS

| | | | |
|---|---|---|---|
| 2,901,210 | 8/1959 | Hebard | 251/137 |
| 3,635,438 | 1/1972 | Peters | 251/137 |
| 3,964,457 | 6/1976 | Coscia | 123/339 |
| 4,181,104 | 1/1980 | Shinoda | 123/102 |
| 4,237,838 | 12/1980 | Kinugawa et al. | 123/339 |
| 4,242,994 | 1/1981 | Keely | 123/339 |
| 4,245,815 | 1/1981 | Willis | 251/129 |
| 4,251,052 | 2/1981 | Hertfelder et al. | 251/129 |
| 4,289,100 | 9/1981 | Kinugawa et al. | 123/339 |
| 4,291,656 | 9/1981 | Miyagi et al. | 123/339 |
| 4,297,978 | 11/1981 | Matsui | 123/339 |
| 4,342,443 | 8/1982 | Wakeman | 251/137 |
| 4,343,329 | 8/1982 | Turansky et al. | 251/137 |

*Primary Examiner*—Raymond A. Nelli

*Attorney, Agent, or Firm*—Cushman, Darby & Cushman

[57] ABSTRACT

In a closed loop idle engine speed control system the actual engine speed is compared with a reference idle speed during engine warm-up periods to control the amount of an air flow introduced to the engine through an auxiliary air delivery system so that the difference between the actual and reference engine speeds is reduced. The reference setting of the idle speed is varied as a function of the engine temperature in order to vary the actual engine speed in response to an increase in the engine temperature. The auxiliary air delivery system includes a linear solenoid type electromagnetic valve which comprises a spring-biased valve member normally maintained in a neutral position with respect to the valve seat to allow introduction of a predetermined amount of auxiliary air to the engine and a pair of coils energized respectively with a current representing the difference in engine speed to move the valve member in opposite directions to increase or decrease the auxiliary air supply.

9 Claims, 13 Drawing Figures

1
1014
READ IN EGN SPD DATA "N" & REF. SPD DATA "NF"
DETECT DIFFERENCE ΔN = NF − N
1015
1016
ΔN ≧ 0 ?
NO
YES
1017
1018
J = J + ΔJ(|ΔN|)
J = J − ΔJ(|ΔN|)
1019
READ IN VALVE CONTROL DATA Ja, Jo, Jb CORRESPONDING TO Jmax, Jmin
2
1020
YES
J ≧ Jmin ?
NO
1021
YES
J ≦ Jmax ?
NO
1022
1023
J = Jmax
J = Jmin
1024
NO
J = Jo ?
YES
COMPUTE I = Jb (1 − (Jo − J)/(Jb − Jo))
1025
COMPUTE I = Ja((J − Jo)/(Ja − Jo))
1027
SUPPLY CURRENT "I" TO COIL B
1026
SUPPLY CURRENT "I" TO COIL A
1028
END OF MAIN ROUTINE
1029

CLOSED LOOP IDLE ENGINE SPEED CONTROL WITH A VALVE OPERATING RELATIVE TO NEUTRAL POSITION

BACKGROUND OF THE INVENTION

The present invention relates to a method and a system for controlling the engine's idle speed during the engine start warm-up and hot idling periods by supplying a controlled auxiliary air flow to the engine.

Cold engines are generally required to have a faster idle speed than warm engines in order to overcome increased viscous and frictional loads encountered during the engine start and warm-up periods. A prior art solution to this problem employed a temperature responsive device such as bi-metallic valve which adjusts the amount of air flow to the engine through a throttle bypass, auxiliary air delivery system to control the idle engine speed as a function of the engine temperature. However, this prior art system must be designed by taking into account the viscosity of particular lubrication oil and if oil of different viscosity is employed the prior art system fails to achieve the desired result. A further disadvantage of this prior art system resides in the fact that if the engine enounters a variation in load such as the compressor operation for air conditioning or the shifting of the torque converter for automatic transmission from the P (parking) or N (neutral) range to the D (drive) range, the idle engine speed tends to reduce considerably from the desired speed.

Closed loop idle air delivery systems have hitherto been developed to meet these problems. One such prior art system employs an electromagnetic valve of the type having a single solenoid coil and a spring-loaded plunger movable between two positions in response to energization of the coil to open and close the passage of an auxiliary air delivery system connected to the primary air delivery system of the engine at a point downstream of the throttle valve which is controlled in response to manual input. Such electromagnetic valves are usually designed so that when the ignition key switch is turned off the valve closes the air delivery passage to ensure normal engine operations against any failure in the solenoid coil circuitry. However, because of the substantially zero clearance during the valve's closed condition, water vapors carried by crankcase ventilation gases or EGR (exhaust gas recirculation) gases tend to condense around the inner wall of the passage near the valve clearance and eventually forms a block of ice thus shutting off the valve opening when the ambient temperature falls below the freezing point. Although this problem could be eliminated by the use of an additional air valve using a bi-metallic spring, this adds to the complexity and cost of the system and reduces the reliability of the system.

SUMMARY OF THE INVENTION

The idle air speed control system of the invention comprises a closed loop auxiliary air delivery system including an electromagnetic valve having a spring-loaded valve member and a pair of coils provided in a stationary core, the valve member being mounted on a plunger which carries a movable core member disposed between a pair of opposed stationary core members. The valve member is normally maintained in a neutral position with respect to the valve seat to allow introduction of a predetermined amount of auxiliary air flow to the engine when the coils are both in a de-energized state. The idle air speed control system includes a control unit which generates a reference idle speed signal as a function of the engine temperature and compares a speed signal indicative of the actual engine speed with the reference idle speed signal in order to derive first and second deviation signals representing the deviation of the actual engine speed in a first or a second direction with respect to the reference speed, respectively. These deviation signals are respectively applied to the first and second coils of the valve to move the valve member in corresponding directions with respect to the neutral position to vary the amount of auxiliary air supplied to the engine during warm-up periods, whereby the difference between the actual and reference idle speeds is reduced. During the time prior to the operation of idle engine speed control the electromagnetic valve is left open to an amount sufficient to prevent the formation of ice in the valve opening, so that the blockage of the auxiliary air delivery system is prevented.

The control system further includes load sensors to detect a variation of engine load to vary the reference idle speed value as a function of the detected engine load, whereby the actual engine speed does not decrease even if the air conditioner or other engine loads are activated during warm-up periods.

Preferably, the control system comprises a microcomputer which is programmed to perform air delivery and fuel quantity controls quickly and accurately. Since the reference idle speed value is a nonlinear function of the engine temperature, the use of microcomputer is particularly advantageous for accurate air delivery and fuel quantity controls during warm-up periods as well as normal engine operating periods.

BRIEF DESCRIPTION OF THE DRAWINGS

The invention will be further described by way of example with reference to the accompanying drawings, in which.

DETAILED DESCRIPTION

Figure 1:
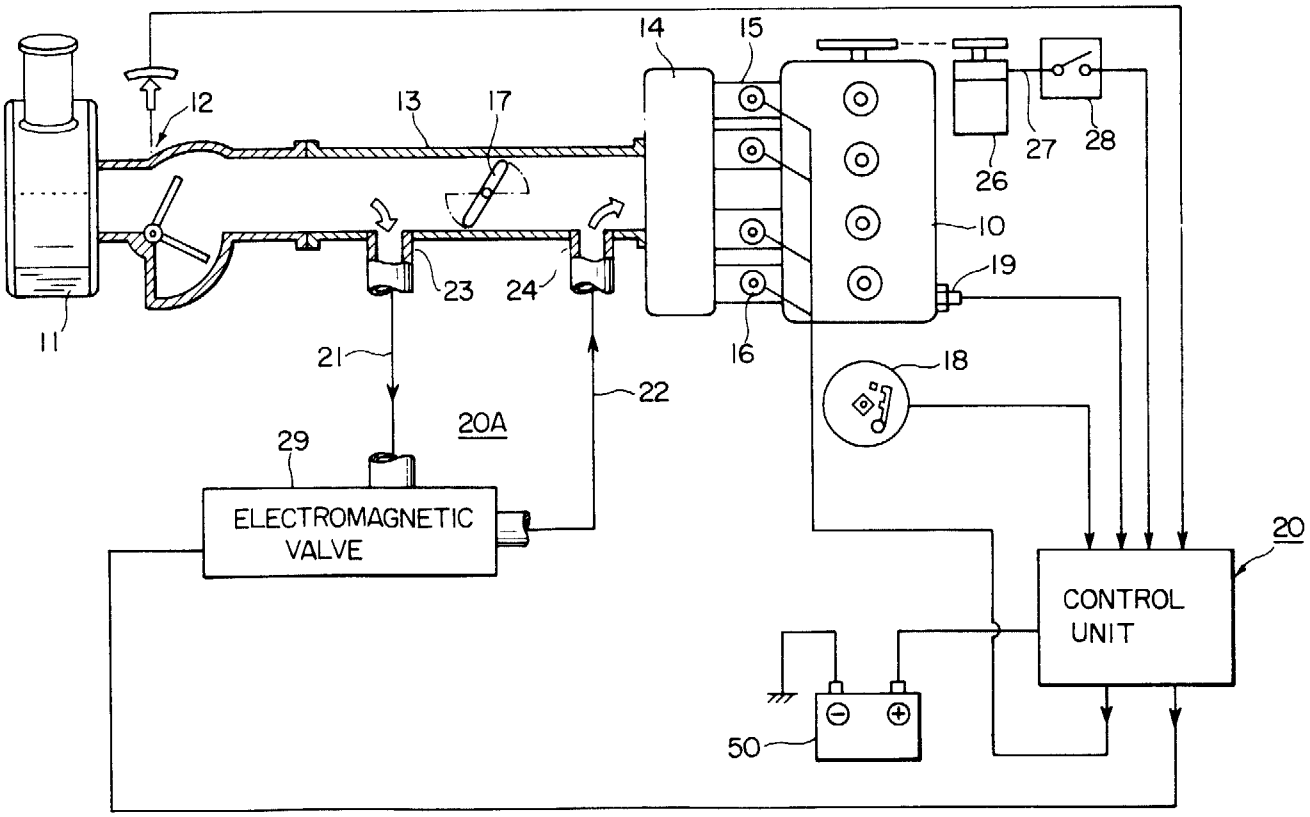
FIG. 1 is an illustration of the idle engine speed control system of the invention for a four-cylinder spark ignition internal combustion engine.

In FIG. 1, the idle speed control system of the present invention is schematically illustrated. The internal combustion engine 10 of a four cycle spark ignition type is supplied with air through the primary air passageway 13, a surge tank 14 and an intake manifold 15 with electromagnetic fuel injection valves 16. An airflow meter 12 is provided at the intake end of the passageway 13 downstream of an air cleaner 11 to derive a signal indicative of the amount of air taken into the engine 10 which is manually controlled by a throttle valve 17 provided in the intake passageway 13 in a manner well known in the art. The fuel injector valves 16 are controlled in response to signals supplied from an electronic control unit 20 in such manner that the air-fuel mixture is controlled at a variable ratio to meet the best engine performance under varying operating conditions. An auxiliary air delivery system 20A is provided which comprises an electromagnetic control valve 29 having an air inlet port connected via an inlet pipe 21 to the primary air delivery passage 13 at a point 23 upstream of the manual throttle valve 17 and an air outlet port connected via an outlet pipe 22 to the passage 13 at a point 24 downstream of the throttle valve 17.

During engine start warm-up or hot idling periods, the control unit 20 determines the amount of fuel supplied to the engine primarily by an engine speed parameter supplied from an engine speed sensor 18 and an intake air quantity parameter supplied from the airflow meter 12 using a temperature parameter supplied from an engine coolant temperature sensor 19 to correct the basic parameters of fuel quantity in accordance with a well known control algorithm.

Figure 2:
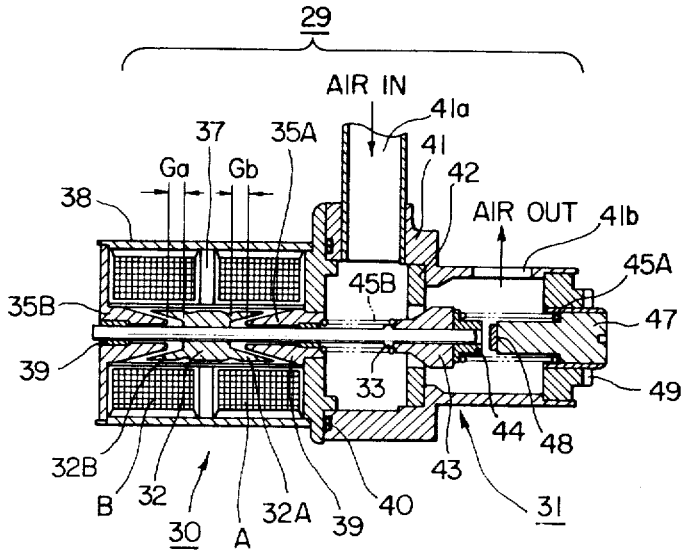
FIG. 2 is an illustration of a cross-sectional view of the electromagnetic valve of FIG. 1.

When the throttle valve 17 is at or nearly closed position, as illustrated in FIG. 1, the inlet and outlet pipes 21, 22 serve as a bypass passageway through which auxiliary air is introduced to the engine for fast idle control in response to a signal supplied to the control valve 29 from the control unit 20. As clearly shown in FIG. 2, the control valve 29 generally comprises a solenoid 30 and a valve 31. The solenoid 30 comprises a pair of identical stationary core members 35A and 35B which are connected by a cylindrical core member 38, and a pair of identical coils A and B which are mounted between the core members 35A and 35B with an annular center core member 37 between them. Each of the stationary core members 35A and 35B is formed with an inwardly tapered section which is disposed concentrically with the coils A and B. Between the tapered sections of the core members 35A, 35B is provided a movable core member 32 having surfaces 32A and 32B which are correspondingly tapered with the surfaces of the stationary tapered sections 35A, 35B. The movable core member 32 is rigidly fixed to a plunger 33 and spaced from the inwardly tapered sections 35A and 35B to form air gaps Ga and Gb, respectively, when the control valve 29 is in a neutral or equilibrium condition in which a prodetermined amount of air is supplied to the engine 10. The plunger 33 is axially slidably mounted on bearings 39 formed in the stationary core members 35A and 35B.

The valve 31 comprises a housing 41 formed with an inlet port **41*a* and an outlet port 41*b* which are connected respectively to the inlet and outlet pipes 21 and 22. A valve member 43 is secured to the plunger 33 by a nut 44 adjacent to a valve seat 42 to define a variable opening. The housing 41 is connected to the solenoid 30 with a sealing member 40, a stopper 47 having an elastic member 48 being adjustably connected to the housing 41 by means of a nut 49 to limit the axial movement of the plunger 33. On opposite sides of the valve member 32 are provided coil springs 45A and 45B to urge the movable core member 32 in opposite directions to locate it in the equilibrium position when the coils A and B are not energized. The tension of the spring 45B is adjustable by the stopper 47 to maintain the movable core member 32 at equal distances from the tapered stationary core members 35A and 35B. In this equilibrium position the amount of air passing through the control valve 29** is maintained at a predetermined value intermediate the maximum and minimum air quantities which respectively correspond to the valve fully open position and valve fully closed position.

Figure 3A:
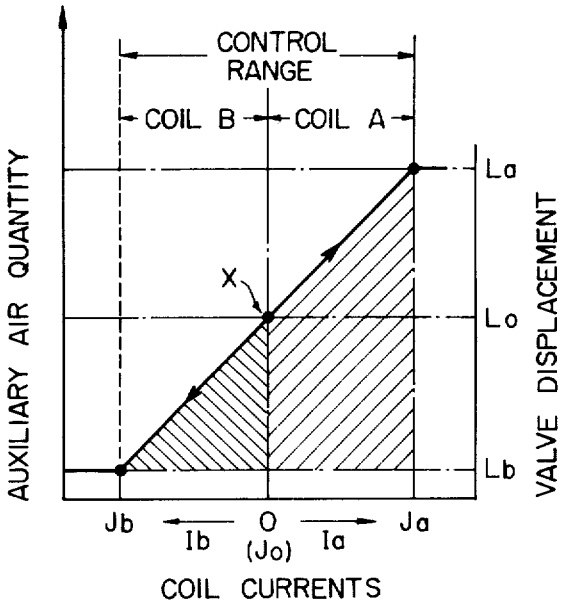
FIGS. 3A and 3B are graphic illustrations of the operating characteristics of the electromagnetic valve of FIG. 2.
Figure 3B:
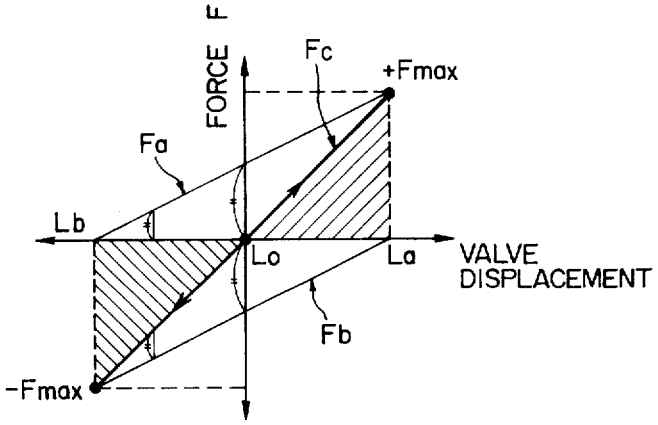

The operation of the control valve 29 will now be described with reference to FIGS. 3A and 3B. When the coils A and B both remain de-energized, the valve member 43 is maintained in the equilibrium position $L_O$ in which the springs 45A and 45B are balanced against each other and in which the amount of auxiliary air corresponds to a point X indicated in FIG. 3A. The amount of auxiliary air is increased from the intermediate value by drawing a current Ia through the coil A causing the movable core member 32 to move toward the stationary core member 35A so that the valve member 43 moves to a point La compressing the spring 45A to a point where the combined spring tension Fc equals Fa−Fb (where Fa and Fb are the tensions of springs 45A and 45B, respectively).

The amount of auxiliary air is decreased from the intermediate value by drawing a current Ib through the coil B causing the movable core member 32 to move toward the stationary core member 35B so that the valve member is displaced to a point Lb compressing the spring 45B to a point where the combined spring tension Fc equals Fa−Fb. In this way, the auxiliary air is continuously varied in either direction with respect to an intermediate value by appropriately controlling the amount of current Ia or Ib.

Figure 4:
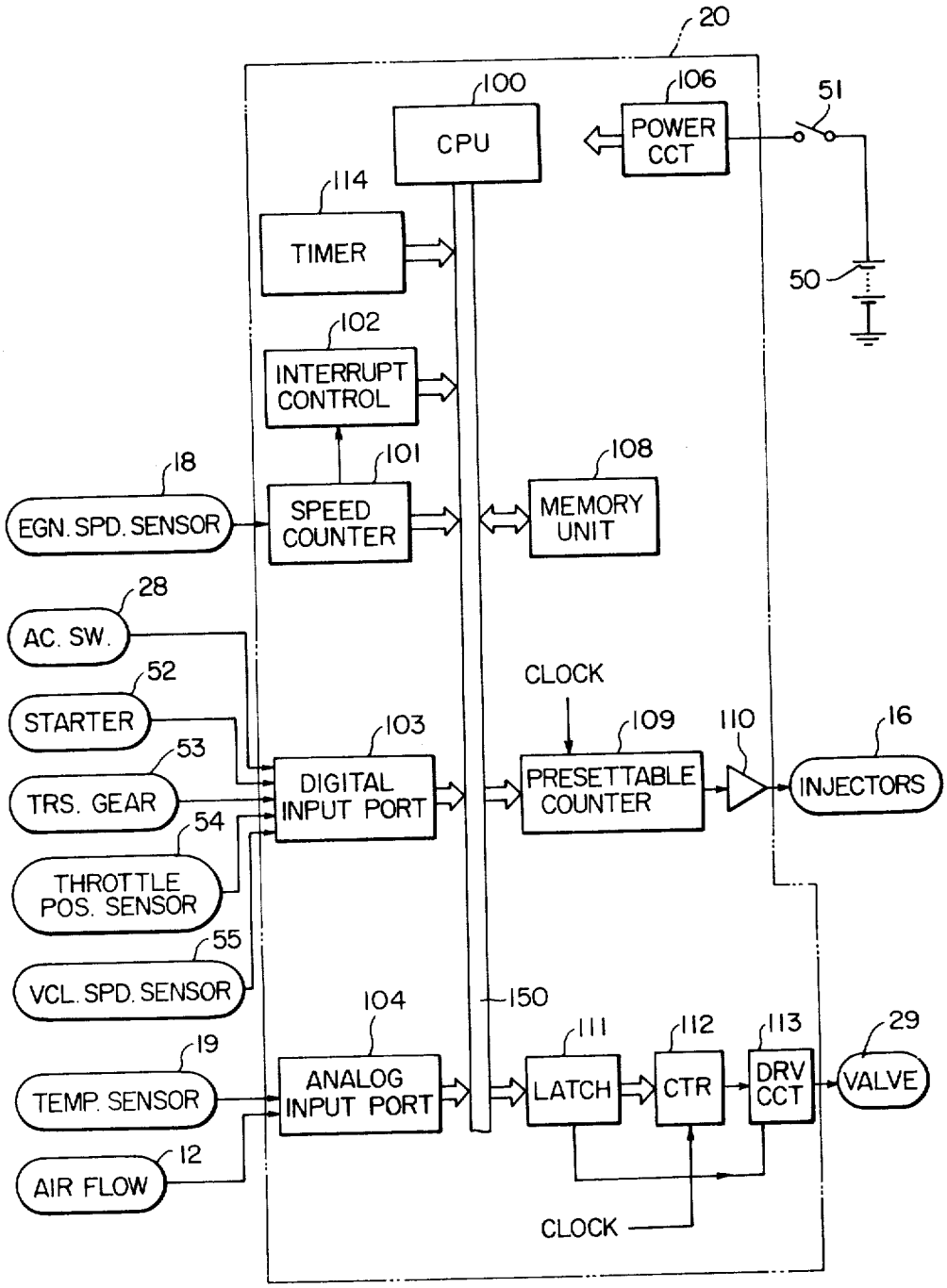
FIG. 4 is a schematic illustration of the general structure of the control unit of FIG. 1.

The currents Ia and Ib are supplied from the control unit 20 in response to various engine load conditions which include an air conditioner load parameter supplied from an air-conditioner power switch 28 which energizes an electromagnetic clutch 27 to operate the air conditioner 26, and in response to engine operating parameters supplied from the speed sensor 18 and the coolant temperature sensor 19. The details of the control unit 20 will now be described with reference to FIG. 4.

The control unit 20 comprises a microcomputer including a central processing unit (CPU) 100 which receives various input data through a common bus 150 and is powered from a power circuit 106 connected through a key switch 51 to a battery 50. An engine speed counter 101 is connected to the speed sensor 18 to provide actual engine speed data to the CPU 100 via the common bus 150 and also provide an interrupt instruction to an interrupt control unit 102 in response to each revolution of the engine crankshaft. The interrupt control unit 102 supplies an interrupt instruction data to the CPU 100 over the common bus 150 to permit it to execute a program which describes the computation of fuel quantity in accordance with a well known algorithm. A digital input port 13 is in receipt of an input signal from the air-conditioner power switch 28, and other various input signals from starter switch 52, transmission gear position sensor 53, throttle position sensor 54, and vehicle speed sensor 55 all of which are schematically shown for simplicity. An analog input port 104, which comprises an analog multiplexer and an analog-digital converter, is in receipt of signals from the coolant engine temperature sensor 19 and the airflow meter 12 and provides the CPU 100 with the corresponding digital data. Program instruction data are stored in the memory unit 108 (which includes read only memory and random access memory) to execute program steps described in a flowchart which will be described later in detail using time data supplied from a timer 114. A presettable counter 109 receives fuel injector open-time data from the CPU 100 over the common bus 150 to provide a fuel injection pulse to the injector valves 16 after amplification at 110. To operate the auxiliary air supply valve 29, the CPU 100 supplies auxiliary air supply data to a latching circuit 111 and thence to a presettable counter 112 which is arranged to count down clock pulses to generate a train of output pulses having a duty cycle that is a function of the amount of current Ia or Ib. The output pulses from the counter 112 are received by a coil drive circuit 113 which also receives air supply increment or decrement command signal from the latch 111.

Figure 5:
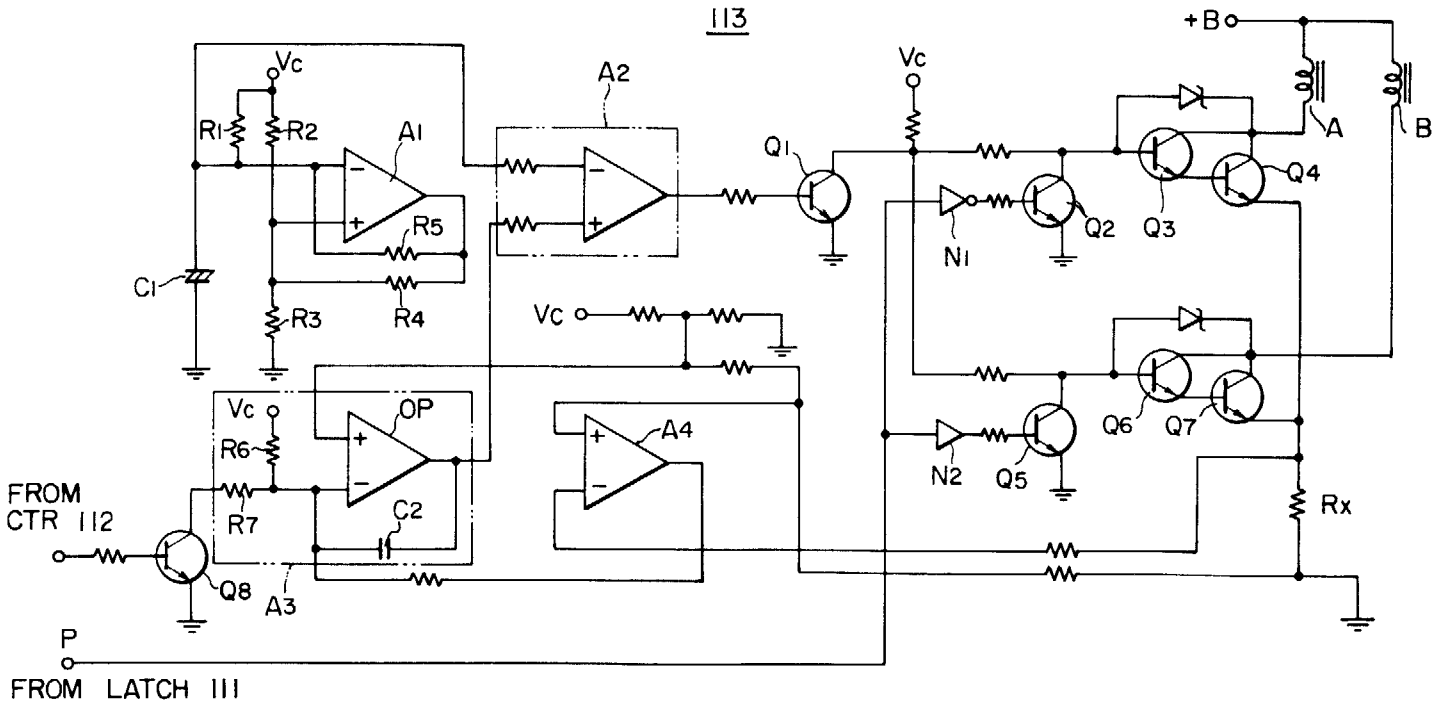
FIG. 5 is an illustration of the circuit diagram of the drive circuit of FIG. 4.

As illustrated in FIG. 5, the drive circuit 113 comprises a ramp generator formed by an operational amplifier A1 having its inverting input connected to a voltage source Vc through a resistor R1 and to its output terminal through a resistor R5 and having its noninverting input connected to a junction between resistor R2 and R3 which are connected in series between the voltage source Vc and ground, and further connected to its output terminal through a resistor R4. The inverting input of amplifier A1 is further connected to ground by a capacitor C1 to generate there across a ramp voltage which is coupled to the inverting input of a voltage comparator A2 to compare an input signal supplied to its noninverting input from an integrator A3. This integrator is formed by an operational amplifier OP having its inverting input connected through a resistor R7 and through the collector-emitter path of a transistor Q8 having its base connected to the output of the presettable counter 112. A capacitor C2 is coupled across the inverting input and output terminals of the operational amplifier OP to constitute an integral time constant with the resistor R7. The noninverting input of the operational amplifier OP is coupled to a reference voltage source. The output of the voltage comparator A2 is coupled to the base of a transistor Q1 having its emitter connected to ground and its collector connected to the voltage source Vc. Transistors Q2 and Q5 have their emitter-collector paths connected bewteen ground and voltage source Vc through respective resistors and have their bases connected to an input terminal P through an inverter N1 and an amplifier N2, respectively. The input terminal P is connected to the latching circuit 111 to receive binary data presetting the air quantity increment or decrement instruction. The collector of transistor Q2 is coupled through a Darlington amplifier formed by transistors Q3, Q4 to the solenoid coil A, and the collector of transistor Q5 is coupled through a Darlington amplifier formed by transistors Q6, Q7 to the solenoid coil B. The emitters of transistors Q4 and Q7 are connected together to ground by a load resistor Rx. A voltage developed across the resistor Rx is coupled to the inverting input of a comparator A4 for comparison with a reference voltage supplied to its noninverting input. The output of the comparator A4 is fed to the inverting input of the operational amplifier OP in order to compensate for the hysteresis characteristic of the coil current and the moving core displacement.

Figure 6:
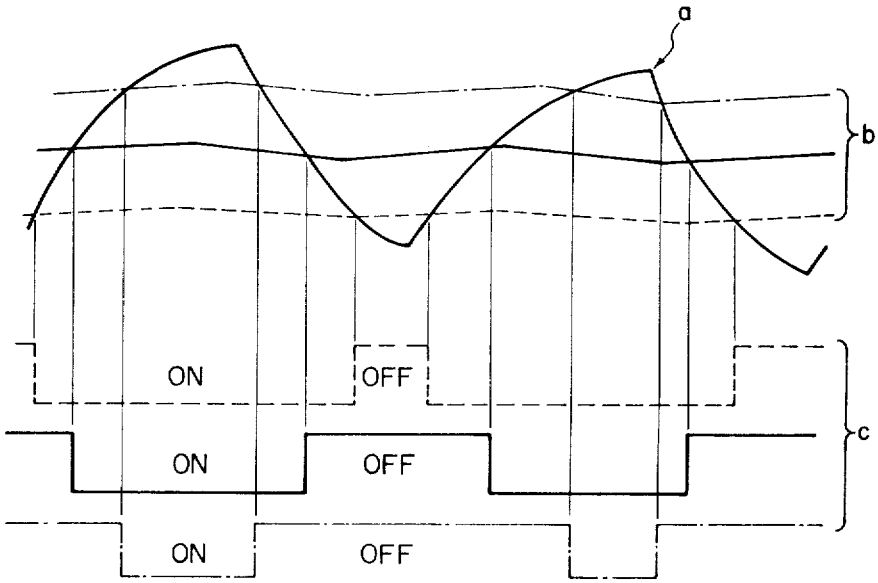
FIG. 6 is an illustration of a waveform diagram useful for describing the operation of the circuit of FIG. 5.

The operation of the circuit of FIG. 5 will be visualized with reference to waveforms shown in FIG. 6. The output pulses from the counter 112 are supplied to the base of transistor Q8 and thence to the integrator A3 to generate a DC voltage as represented by curves b in FIG. 6, the DC voltage being compared with the instantaneous value of the ramp voltage a developed across the capacitor C1. The voltage comparator A2 generates a train of pulses c which occur when the DC voltage is higher than the instantaneous value of the ramp voltage a. The output of the comparator A2 switches on and off the transistor Q1 so that a rapid change in voltage occurs at the collectors of transistors Q2 and Q5. If a high level voltage is applied to the input terminal P, the transistor Q2 is rendered nonconductive to allow the transistors Q3 and Q4 to supply current to the coil A. Conversely, application of a low level voltage to the terminal P will cause transistor Q2 to conduct and transistor Q5 to turn off to allow transistors Q6, Q7 to supply current to the coil B. Therefore, the coil A and B are each supplied with an average current which is proportional to the duty cycle of the pulses supplied from the counter 112.

Figure 7A:
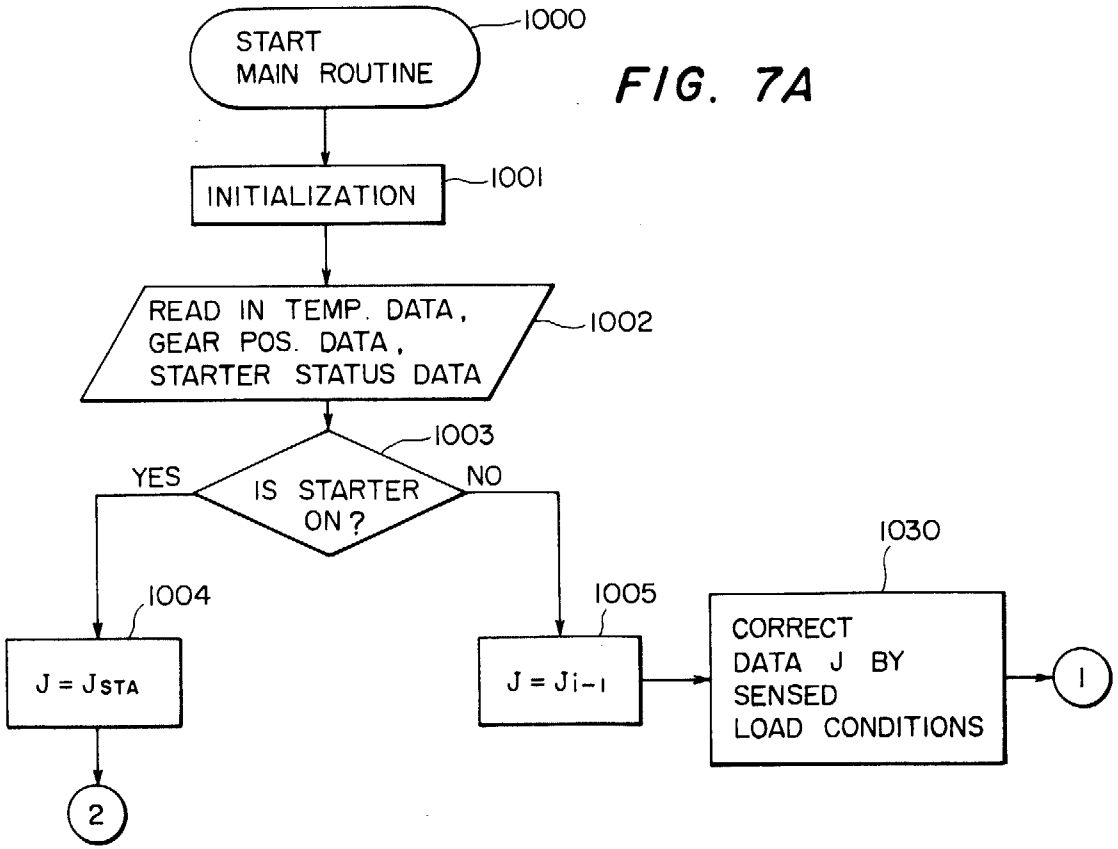
FIGS. 7A and 7B are illustrations of a flowchart describing the program steps which the microprocessor of FIG. 4 is programmed to perform.
Figure 7B:
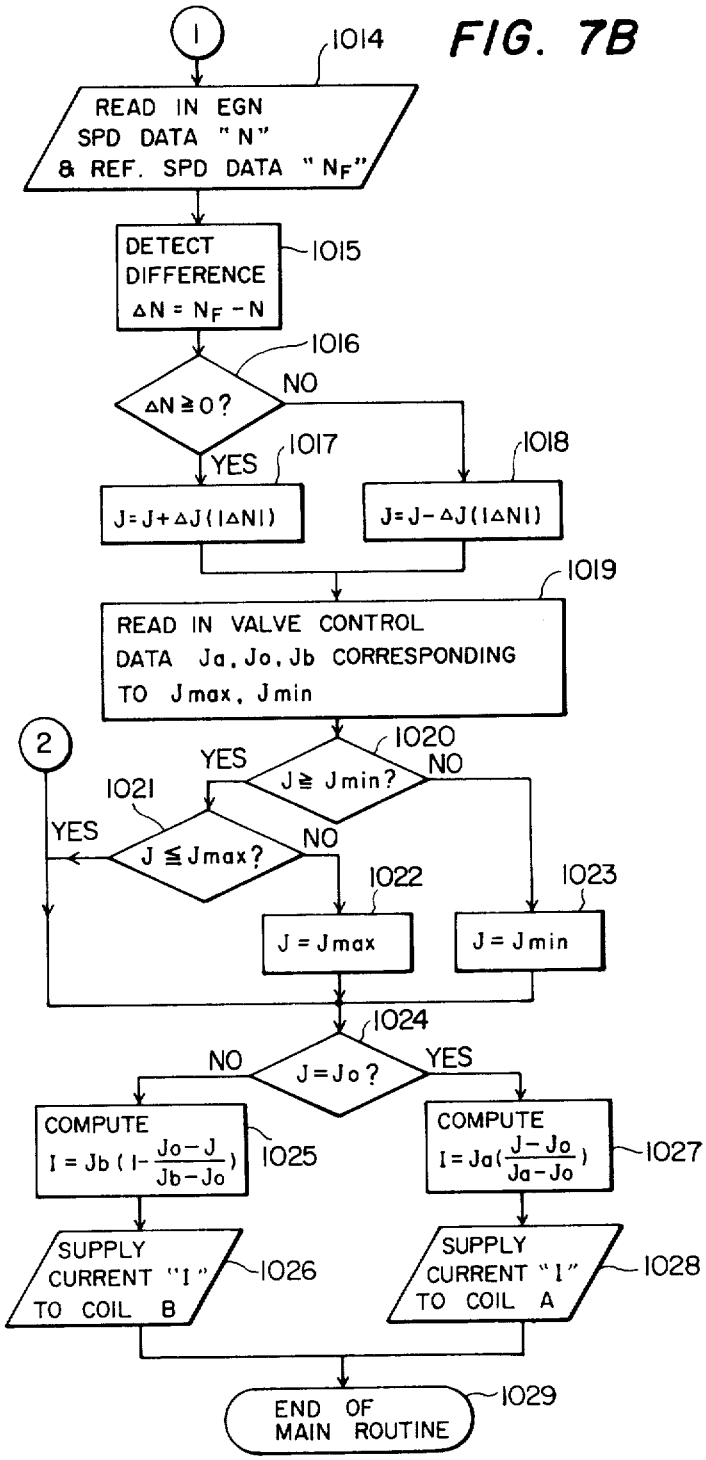
Figure 8A:
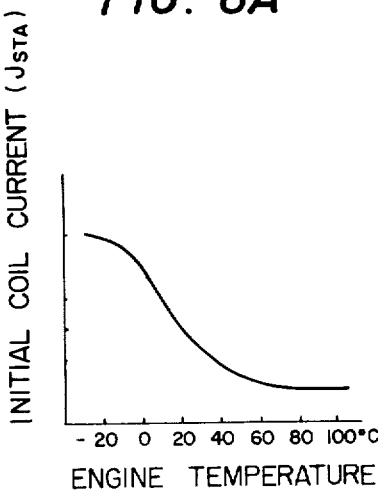
FIGS. 8A to 8D are graphic illustrations of various engine and coil operating characteristics which are stored in binary form in the memory unit of FIG. 4.

FIGS. 7A and 7*b* are illustrations of a flowchart which describes the program of the microcomputer 20 which derives auxiliary air supply data. In FIG. 7A, the main program routine is started at step 1000 when the ignition key switch 51 and starter switch 52 are operated. Various data which are stored in the memory 108 are initialized at step 1001. At step 1002, the CPU 100 reads the digital data from the analog input port 104 which are derived from the coolant temperature sensor 19, air-conditioner switch 28, transmission neutral position sensor 53 and starter switch 52. At step 1003, the CPU 100 checks to see if the starter switch is in an ON state and goes to a step 1004 if it is ON to read off initial coil-current data $J_{sta}$ (see FIG. 8A) stored in the memory 108 as a function of the coolant temperature data, and then proceeds to a step 1024.

Figure 8B:
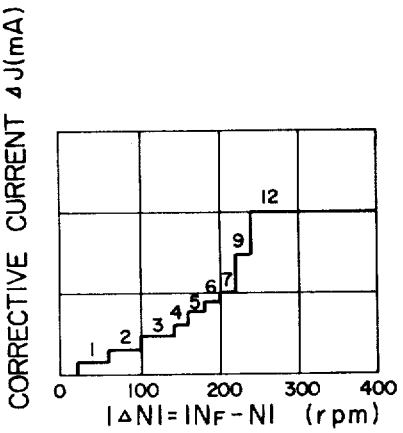
Figure 8C:
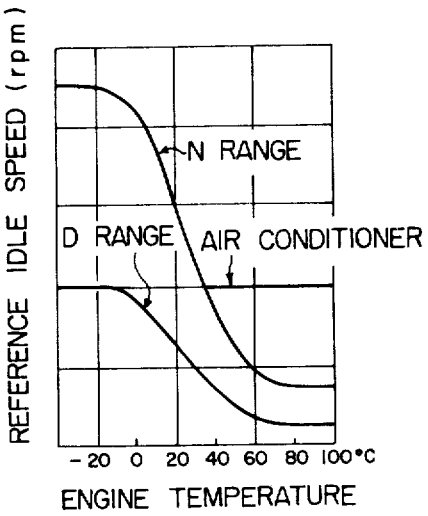
Figure 8D:
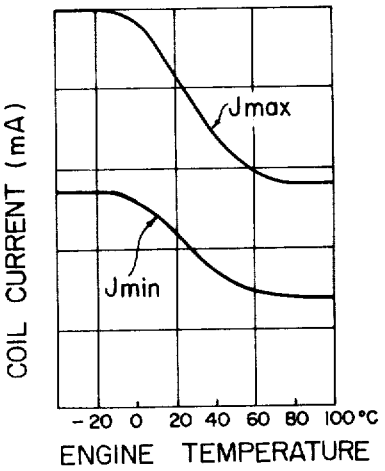

If in the step 1003 the CPU 100 detects that the starter switch 52 is not in the ON state, it proceeds to a step 1005 to read a valve control datum $U_{i-1}$ which was derived in the previous routine and then proceeds to a step 1030 to correct the data J in accordance with the engine operating parameters which include the operating state of the air conditioner power switch 28 and gear position sensor 53. In FIG. 7B, the CPU 100 proceeds to a step 1014 to read the engine speed data N from the counter 101 and a reference idle engine speed datum $N_F$ from the memory 108 as a function of the coolant temperature (see FIG. 8C). A program step 1015 is then executed to detect the difference between the data N and $N_F$, which difference is used in a step 1016 to determine whether it is equal to or greater than zero. If the difference value is positive or zero, a "true" decision is made to execute a step 1017 in which the CPU 100 reads coil-current correction data ΔJ from the memory 108 as a function of the absolute value of the difference data ΔN (see FIG. 8B) and sets the data J to $J=J+\Delta J(|\Delta N|)$. If the difference value is detected as being negative at step 1016, a step 1018 is executed to set the data J to $J=J-\Delta J(|\Delta N|)$. After execution of the step 1017 or 1018, the CPU 100 goes to a step 1019 to read a set of maximum and minimum control data Jmax and Jmin as a function of the coolant temperature (see FIG. 8D) from the memory 108 as well as a set of upper and lower limit data Ja, Jb and an intermediate datum Jo which corresponds to the neutral position of the control valve 29 Ja and Jb are uniquely determined in response to the data Jmax and Jmin. In subsequent steps 1020 to 1023, the coil-current valve control data J which was determined in the previous step 1017 or 1018 is checked to see if it falls within a range between Jmin and Jmax. If J<Jmin is detected in the step 1020, the data J is set to J=Jmin at step 1023, if J>Jmax, the CPU executes the step 1022 to set the data J to J=Jmax, and then proceeds to a step 1024. If the data J is found to lie within the predetermined range, the CPU 100 proceeds through steps 1020 and 1021 to the step 1024. At step 1024, the data J is compared with the intermediate coil-current data Jo (which has been read in at step 1019) to determine their relative magnitudes. If J≧Jo, a step 1027 is executed to compute a formula I=Ja(J−Jo/-Ja−Jo). The computed data I is supplied to the coil A at step 1028 to energize it with a corresponding current converted by the drive circuit 113 as mentioned previously, and the auxiliary air supply routine is terminated at step 1029. If J is smaller than Jo, a step 1025 is executed to compute a formula I=Jb(1−Jo−J/Jb−Jo) and this computed data I is supplied to the coil B via the drive circuit 113 at step 1026.

The above program steps are repeatedly executed to control the amount of auxiliary air flow to the engine 10 to vary its speed so that the difference between the actual engine speed value N and the reference idle speed value $N_F$ is substantially reduced to zero. When the ignition key switch is turned off, the valve member 43 of the control valve 29 returns to the neutral position in which a sufficient amount of opening is ensured to prevent water vapor from forming a block of ice which might otherwise block the passage of auxiliary air delivery system if the ambient temperature drops below the freezing point.

Although in the foregoing description a microcomputer is employed as a preferred embodiment of the invention to serve as the control unit 20 of the auxiliary air delivery system, it is obvious that the control unit 20 could also be realized with analog or digital wired logic circuits rather than with programmed logic circuits.

What is claimed is:

1. A method for controlling the idle speed of an internal combustion engine by supplying thereto an auxiliary air flow through an auxiliary air delivery system including an electromagnetic valve, said valve comprising a valve member movable with respect to a valve seat, said valve member being normally located at a neutral position between two positions at which said air flow is at maximum and minimum respectively, said valve member being spaced a sufficient distance from said valve seat when located at said neutral position to prevent vapor-laden air from clogging the space between said valve member and said valve seat when the vapor is frozen, the method comprising:

(a) detecting the actual idle speed of said engine;

(b) establishing a reference idle speed;

(c) deriving a deviation signal representing the deviation of said actual idle speed with respect to said reference idle speed;

(d) deriving a valve control signal from said deviation signal;

(e) detecting whether said valve control signal is more or less than a predetermined value corresponding to said neutral position;

(f) moving said valve member in a first direction away from said neutral position when said valve control signal is more than said predetermined value to increase the auxiliary air flow and moving said valve member in a second, opposite direction away from said neutral position when said valve control signal is less than said predetermined value to decrease the auxiliary air flow; and (g) moving said valve member forcibly to said neutral position when said electromagnetic valve is de-energized.

2. A method as claimed in claim 1, further comprising the step of detecting an operating parameter of said engine, and wherein the step (b) comprises varying said reference idle speed as a function of said detected operating parameter.

3. A system for controlling the idle speed of an internal combustion engine having a primary air delivery system through which main air flow is introduced to the engine, comprising:

sensor means for detecting the speed of said engine and generating therefrom an engine speed signal;

an auxiliary air delivery system for introducing an auxiliary air flow to said engine;

an electromagnetic control valve provided in said auxiliary air delivery system and comprising a pair of first and second coils for producing a magnetic field when energized, a valve seat, and a valve member movable with respect to said valve seat in response to said magnetic field to control said auxiliary air flow, said valve member being normally located at a neutral position when said coils are de-energized between two positions at which said air flow is at maximum and minimum respectively, said valve member being spaced a sufficient distance from said valve seat when located at said neutral position to prevent vapor-laden air from clogging the space between said valve member and said valve seat when the vapor is frozen; and means for energizing said first coil to cause said valve member to move away from said neutral position when said engine speed is more than a reference idle speed and energizing said second coil to cause said valve member to move away in opposite direction from said neutral position when said engine speed is less than said reference idle speed.

4. A system as claimed in claim 3, further comprising second sensor means for detecting an operating parameter of said engine and generating therefrom an engine parameter signal, wherein said energizing means comprises processing means comprising means for deriving a deviation signal representing the deviation of said engine speed signal from a reference idle speed signal corresponding to a reference idle speed, means for deriving from said deviation signal a valve control signal, and means for detecting whether the valve control signal is more or less than a reference value corresponding to said neutral position for respectively energizing said coils.

5. A system as claimed in claim 4, further comprising means for detecting the temperature of said engine and means for varying said reference idle speed signal as a function of said detected engine temperature.

6. A system as claimed in claim 3, wherein said electromagnetic control valve comprises a stationary core having a pair of opposed core members each having a surface tapered toward the other, and a movable core member between said stationary core members having a pair of surfaces tapered correspondingly with the tapered surfaces of said stationary core members, said movable core member being connected by a shaft with said valve member to move between said stationary core members in opposite directions in response to said first and second coils being energized with said first and second deviation signals, respectively.

7. A system as claimed in claim 6, further comprising means for compensating for the hysteresis characteristic of said electromagnetic control valve.

8. A system as claimed in claim 7, wherein said compensating means comprises first and second amplifier circuits for respectively supplying said first and second deviation signals to said first and second coils, said first and second amplifier circuits having a common resistance element for developing thereacross a voltage in response to the current supplied to said first or second coil, means for deriving a compensation signal when said voltage deviates from a reference voltage, and means for supplying said compensation signal to said first and second coils.

9. A system as claimed in claim 5, 6, 7 or 8, wherein said processing means comprises a microcomputer which is programmed to perform the following steps:

(a) deriving a valve control digital signal;

(b) detecting the difference between said engine speed signal and said reference idle speed signal;

(c) detecting whether said difference is positive or negative;

(d) correcting said valve control digital signal in a first direction as a function of said difference when said difference is detected as being positive and correcting said valve control digital signal in a second direction as a function of said difference when said difference is detected as being negative;

(e) establishing a set of upper and lower limit digital values corresponding to the maximum and minimum current values of each of said coils as a function of said detected temperature of said engine and an intermediate digital value corresponding to a current value intermediate said maximum and minimum current values;

(f) detecting whether said corrected valve control digital signal is greater or smaller than said intermediate reference digital signal;

(g) generating a first current for said first coil as a function of the difference between said upper limit digital value and said corrected valve control digital signal when said corrected valve control digital signal is detected as being greater than said intermediate digital value and generating a second current for said second coil as a function of the difference between said lower limit digital value and said corrected valve control digital signal when said corrected valve control digital signal is detected as being smaller than said intermediate digital value; and (h) repeating the steps (a) to (g).

* * * * *